US008973926B1

(12) United States Patent
Lensing

(10) Patent No.: US 8,973,926 B1
(45) Date of Patent: Mar. 10, 2015

(54) ROLLING CHAIR AND TOOL BIN

(71) Applicant: Patrick Lensing, Van Buren, AR (US)

(72) Inventor: Patrick Lensing, Van Buren, AR (US)

( * ) Notice: Subject to any disclaimer, the term of this patent is extended or adjusted under 35 U.S.C. 154(b) by 0 days.

(21) Appl. No.: 13/804,928

(22) Filed: Mar. 14, 2013

Related U.S. Application Data

(60) Provisional application No. 61/611,689, filed on Mar. 16, 2012.

(51) Int. Cl.
*B25H 5/00* (2006.01)
*B62M 1/00* (2010.01)

(52) U.S. Cl.
CPC ..... *B62M 1/00* (2013.01)
USPC ..... 280/32.5; 280/47.34; 297/188.08

(58) Field of Classification Search
CPC ..... A47C 7/002; A47C 7/004; A47C 7/006; A47C 9/02; A47C 9/027; B25H 5/00
USPC ..... 280/32.5, 32.6, 87.01, 47.34, 47.38, 280/79.11, 79.2; 297/188.08
See application file for complete search history.

(56) References Cited

U.S. PATENT DOCUMENTS 2,780,277 A * 2/1957 Ries et al. ..... 248/408
3,917,203 A * 11/1975 Heubeck et al. ..... 248/158
4,632,410 A 12/1986 Bainbridge et al. ..... 280/32.5
D353,058 S * 12/1994 Dallas ..... D6/336
5,377,943 A * 1/1995 Perl ..... 248/188.7
5,707,067 A 1/1998 Smith ..... 280/32.6
5,752,684 A * 5/1998 Larkin ..... 248/188.7
6,105,719 A 8/2000 Lensing ..... 182/116
6,733,073 B2 * 5/2004 Whiteside et al. ..... 297/188.08
7,097,241 B2 8/2006 Tally et al. ..... 297/118
D531,419 S * 11/2006 Whiteside et al. ..... D6/352
7,481,438 B2 1/2009 Hernandez ..... 280/32.6
7,597,392 B1 10/2009 Gilmore ..... 297/217.1
D608,558 S 1/2010 Rush ..... D6/367

* cited by examiner

*Primary Examiner* — John Walters

(74) *Attorney, Agent, or Firm* — Keisling & Pieper PLC; Trent C. Keisling

(57) ABSTRACT

The invention includes a rolling chair for mechanics and the like to use on a floor to move around a work area. The rolling chair has a rigid frame with legs extending outwardly from a central riser housing an adjustable cylinder supporting a padded seat. The frame supports a rotary platform with a large section and a smaller walled section for storing tools or parts. The rolling chair is suspended above the ground by castered wheels secured to a leg terminal end. The castered wheels rotate vertically and horizontally. The castered wheels may be large and the central riser may protrude above and below the frame. The platform has an outer perimeter above the vertical axes of the castered wheels.

8 Claims, 9 Drawing Sheets

ROLLING CHAIR AND TOOL BIN

CROSS-REFERENCE TO RELATED APPLICATIONS

This application claims priority to and is a continuation of patent application Ser. No. 61/611,689, filed Mar. 16, 2012, entitled Rolling Chair and Tool Bin.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The invention pertains to improvements in rolling chair and tool bins and particularly the arrangement of the apparatus and mechanism associated therewith. Known art can be found in Class 280, subclasses 32.6 and 32.5 and in Class 297 subclasses 118 and 217.1, and in other classes and subclasses.

2. Description of the Known Art

Those skilled in the art will appreciate that it is often desirable to employ rolling chair and tool bins to work around vehicles and the like. Often, the mechanic will spend considerable time in proximity to a vehicle while working on it and will often need to maneuver about the vehicle. The known art has provided a variety of stools and similar chairs to meet this need and such devices have been generally acceptable. Others, such as inspectors and other types of workers also need the ability to work and to move around a vehicle or the like, and they have used these devices as well.

The typical stools provided in the art have rotating castors fixed to a frame that may not facilitate vertical or up-down seat movement relative to the frame. Such fixed seat stools cannot move upwardly or downwardly easily and quickly, the user is hampered when working on a workpiece and may not work as efficiently as possible. Other conventional stools using vertically movable seats typically employ standard and relatively small caster wheels (e.g. 2 inch wheels or the like). Such small caster wheels often are impeded when used in areas such as automotive shops by commonly encountered debris such as nuts, bolts, small pieces of metal, and the like.

Most previously proposed solutions for such problems have not provided devices with easily moved seats that are easily deployable and that enable the user to quickly and efficiently adjust the seat and store tools and parts conveniently. Therefore, a need exists for a new and improved rolling chair and tool bin that can improve the efficiency of such workers. Thus, an improved stool that addresses the perceived shortcomings of the known art is desirable.

Known art which may be relevant to the present invention includes the following patents with their abstracts, the teachings of which are incorporated by reference.

U.S. Pat. No. 7,481,438, issued to Hernandez on Jan. 27, 2009, entitled Multi-position mechanic's creeper with tool tray is for a multi-position creeper that has multiple seating positions including a supine configuration, an inclined seating configuration and an upright seating configuration. The creeper includes a frame having a first support frame, a second support frame and a third support frame. A locking mechanism is utilized to pivotally lock the first and second support frames together. A coupling assembly is used to connect the second and third support frames together. This device fails to address the perceived need of the art.

U.S. Pat. No. 4,632,410, issued to Bainbridge, et al., on Dec. 30, 1986, entitled Combination tool caddy and stool is for a combination tool caddy and stool comprises a base, having a pedestal-type seat mounted on a central portion of the base. A vertical support post is mounted on a marginal portion of the base in a laterally spaced apart relationship with the seat. A tray is supported on the vertical post in a horizontal orientation by an adjustable coupling which permits the tray to be moved vertically and horizontally to a location that is conveniently reachable by a user seated on the seat. The tray can also be mounted on the support post in a vertical orientation to form a backrest for the seat. The seat and the tray are preferably attached to the base by interchangeable coupling members, so that the seat can be removed, and the tray supported on the center of the base to provide additional stability. Wheels may be provided on the base so that the unit can be manually propelled by a seated user from one work site to another. This device also fails to address the perceived need of the art.

U.S. Pat. No. 7,597,392, issued to Gilmore on Oct. 6, 2009, entitled Multi-function mobile stool is for a multi-function mobile stool that attaches includes a bucket with a seat attached via a lanyard. The invention includes a wheeled base that includes a rotating storage container that surrounds the location where the bucket is situated upon the base. The bucket may be removed and carried off via a handle. The cushion may be removed from the top of the bucket and allowed to dangle to the side via the lanyard. This device also fails to address the perceived need of the art.

U.S. Pat. No. 7,097,241, issued to Tally, et al., on Aug. 29, 2006, entitled Mechanic's seat and step stool is for a combination step stool and mechanic's seat in the form of a molded plastic, generally parallelepiped configuration includes a seat on one side supported on casters on the opposite side with a step stool surface adjacent the backside of the seat and spaced from a front side surface of the seat which includes a recess tray for tools and other items. This device also fails to address the perceived need of the art.

U.S. Pat. No. 5,707,067, issued to Smith on Jan. 13, 1998, entitled Convertible work creeper, seat and platform is for a creeper and work seat that has two end platforms (1, 5) in sliding attachment to slide rods (4, 35, 36) in slideways (3, 6) with which the two end platforms can be slid apart to opposite ends of a central platform (7) to form a full-length creeper in creeper mode (11). The central platform becomes a work seat and the two end portions become a shelf platform under the work seat when the two end platforms are slid edge-to-edge in a seat mode (10). Seat-support members (12, 13) are attached pivotally to the central platform and to the two end platforms to support the central platform as a seat in a seat mode and to position the central portion between the two end platforms in a creeper mode. This device also fails to address the perceived need of the art.

U.S. Pat. No. 6,105,719, issued to Lensing on Aug. 22, 2000, entitled User-configurable mechanics stool is for a highly mobile support cart for automotive service personnel presents an elevated support platform over the engine compartment of a vehicle undergoing service. The wheeled frame, ideally supported by a smooth, concrete surface, comprises a rigid, transverse base from which rigid, elongated rails outwardly diverge. The frame mounts an extensible, slightly inclined ladder that supports the work platform. The frame rails and base are equipped with suitable caster wheel assemblies for locomotion. The divergent, reinforced frame design enhances stability and structural integrity. The extensible ladder transported by the frame projects upwardly from the rear. The ladder comprises a lower half pivoted to the frame that telescopingly receives a sliding upper half. Registered locking orifices are pinned by a spring biased clip system to lock the ladder halves against axial displacement. The locking clip comprises a generally C-shaped clasp that is yieldably, spring biased to a locking position. One end of the clasp penetrates aligned locking orifices in the ladder. Ladder orientation is established by a pivotal support brace angularly extending between the frame rails and the ladder. The brace terminates in a lower, transverse foot adapted to be cradled between aligned notches defined in supporting receptacle structure mounted on the frame rails. This device also fails to address the perceived need of the art.

U.S. Pat. No. D608,558, issued to Rush on Jan. 26, 2010, entitled Mechanic's shop stool shows a shop stool. This device also fails to address the perceived need of the art.

Also, commercially available equipment and components may be relevant, including commercial castors, metal frames, padded seats and the like. Such equipment may be used in implementing an exemplary embodiment in accordance with the present invention.

None of these references, either singly or in combination, disclose or suggest the present invention. It is desirable to have an improved stool to address the perceived shortcomings of the prior art.

While it is evident from past attempts that wheeled stools are desirable, the known art is limited in its teaching and utilization, and an improved system is needed to overcome these limitations. An improved stool should provide a simple and efficient system for meeting the various needs of mechanics and the like. The system should enable the user to work efficiently and provide mobility in the garage or other locale as desired.

SUMMARY OF THE INVENTION

The present invention addresses the perceived needs in the known art discussed above. In this regard, the present invention substantially fulfills this need. The rolling chair and tool bin according to the present invention substantially departs from the conventional concepts and designs of the known art, and in doing so provides a novel apparatus primarily developed for the purpose of providing an efficient wheeled platform for use when working on vehicles and the like.

In one exemplary embodiment in accordance with the present invention an improved rolling chair and tool bin using casters mounted on a rigid platform is provided. The rolling chair includes a central gas powered cylinder that a user may actuate to move the seat higher or lower with respect to the base when the rolling chair is deployed on a supporting flat surface such as a garage floor or the like. A lower rotary tool tray and storage bin is also mounted on the rigid frame and rotatable similarly to a lazy susan or the like. The frame may incorporate hollow members into its structure to decrease the overall weight of the rolling chair.

In another exemplary embodiment, large caster wheels (e.g. six inch wheels) are used to enable the stool to roll easily navigate debris. The device uses a drop sleeve placing a portion of the gas cylinder below the rigid platform to offset the additional rise in the height of the platform so that a desirable seat height may still be achieved.

The apparatus of the invention is capable of receiving additional, optional features which are not a part of the present invention. For example, a purchaser or user may specify an optional adjustable padding feature whereby the padding can be tilted or moved to accommodate various positions of use. Other optional features, some of which may be illustrated herein, may or may not be included with apparatus incorporating the basic aspects of present invention.

In addition to providing the features and advantages referred to above, it is an object of the present invention to provide a rolling chair and tool bin that facilitates user movement in a garage.

It is another object of the present invention to provide a rolling chair and tool bin able to move over debris and the like.

It is still another object of the present invention to provide a rolling chair upon which the suspension may be adjusted by the user.

It is a further object of the present invention to provide a rolling chair that is easily deployable with minimal site preparation.

It is a still further object of the present invention to provide a rolling chair that may be used by multiple users with little to no modification.

It is an object of the present invention to provide an improved rolling chair that may be used by service personnel at field locations.

It is an object of the present invention to provide a rolling chair that may be easily adapted to existing locales such as garages, construction sites, inspection sites and the like.

It is a still further object of the present invention to provide a system that is quickly and easily deployable by a user.

These and other objects and advantages of the present invention, along with features of novelty appurtenant thereto, will appear or become apparent by reviewing the following detailed description of the invention in conjunction with the appended drawings.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

The present invention addresses the perceived needs in the known art discussed above. In this regard, the present invention substantially fulfills this need. The rolling chair and tool bin according to the present invention provides a wheeled platform for use when working on a vehicle or the like.

Figure 1:
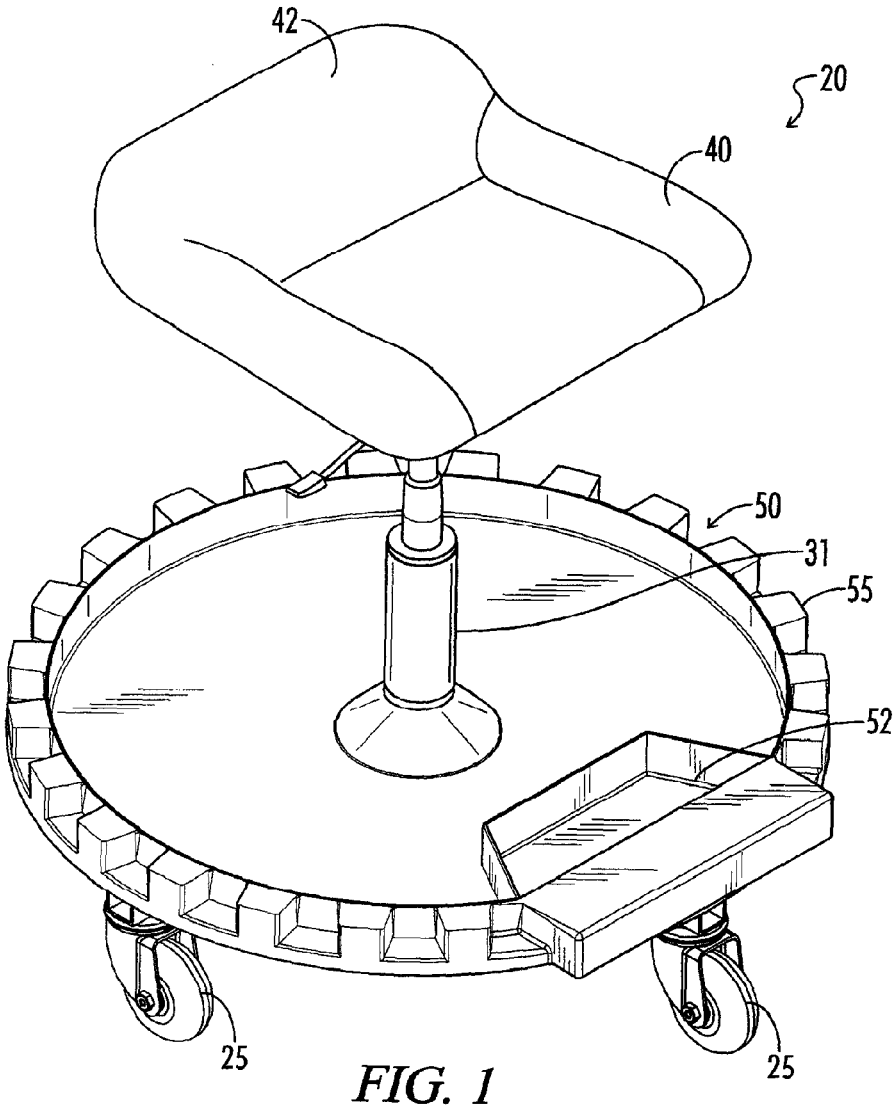
FIG. 1 is a perspective view taken generally from the top of one exemplary embodiment of the rolling chair and tool bin at a site in accordance with the present invention.
Figure 2:
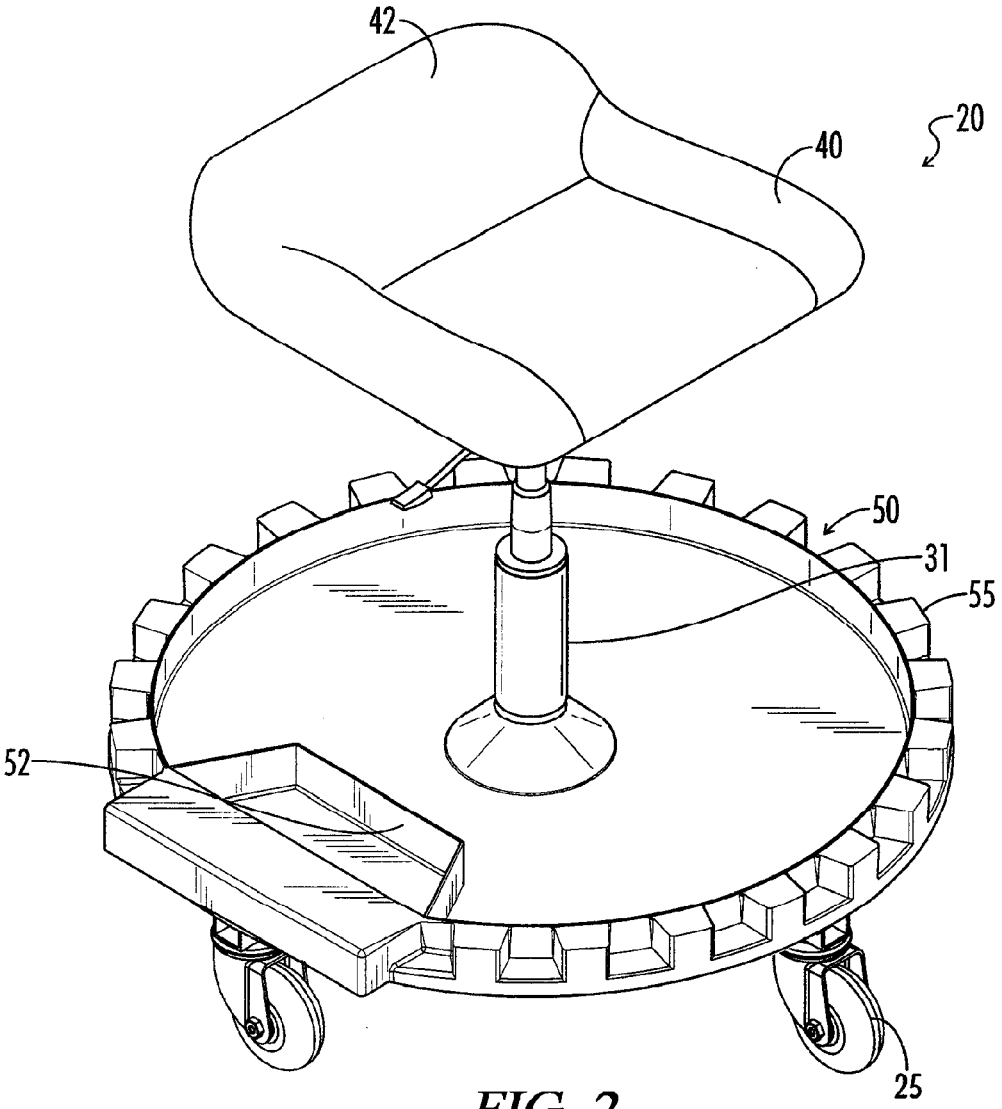
FIG. 2 is a perspective view similar to FIG. 1 but showing the tray with the tool bin in a moved position.
Figure 3:
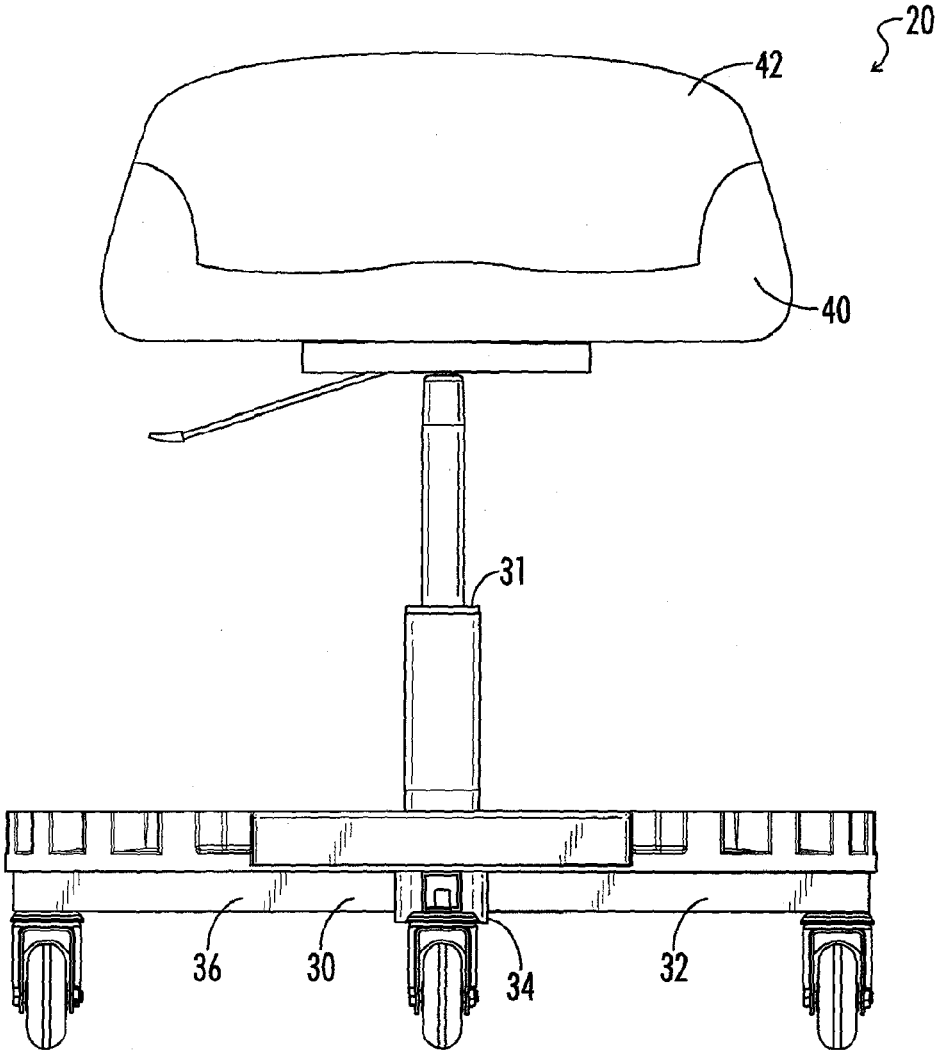
FIG. 3 is a front elevational view thereof.
Figure 4:
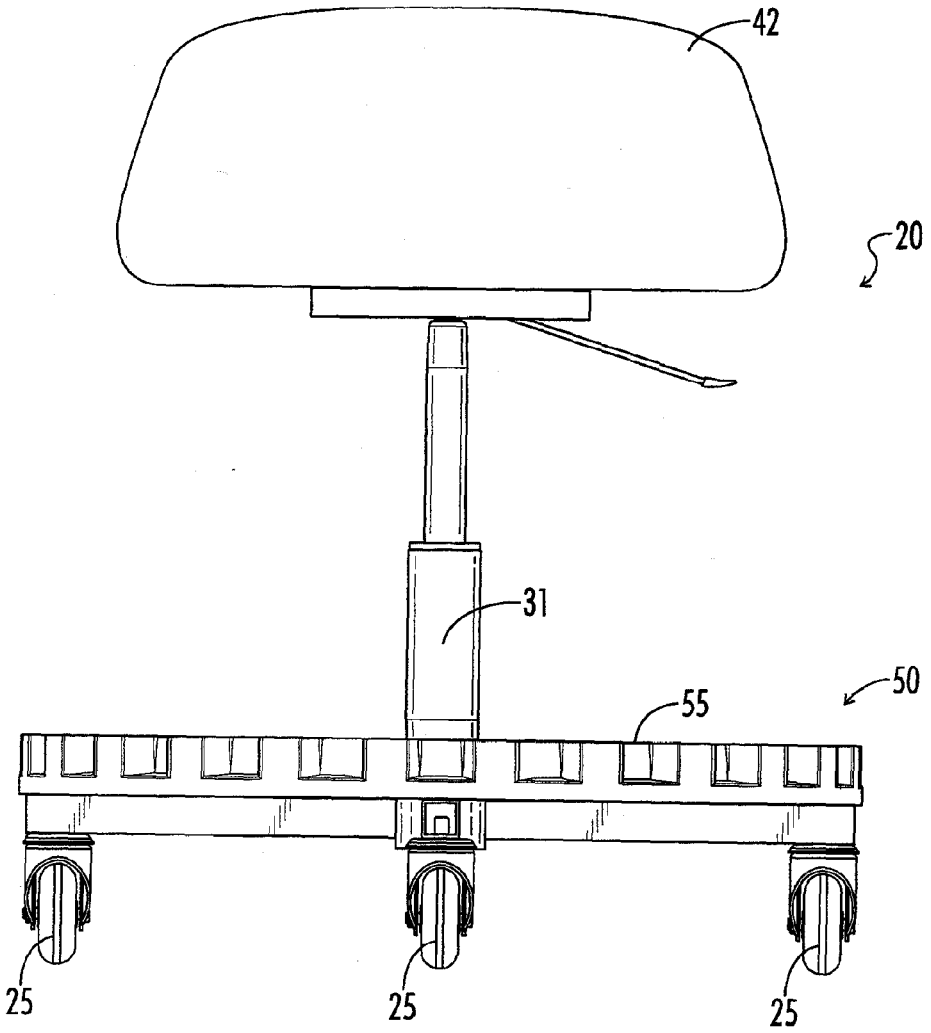
FIG. 4 is a rear elevational view thereof.
Figure 5:
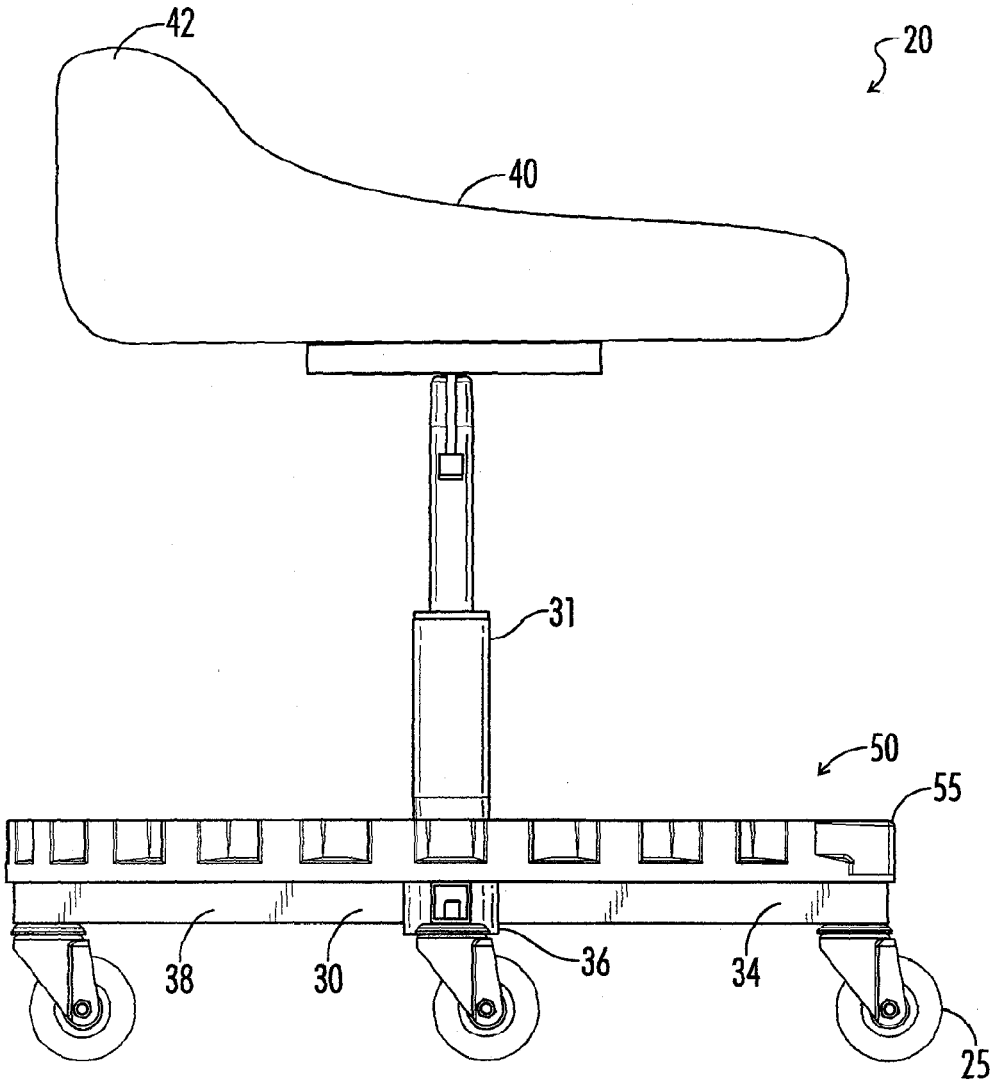
FIG. 5 is left side elevational view thereof with the right side being a mirror image thereof.
Figure 6:
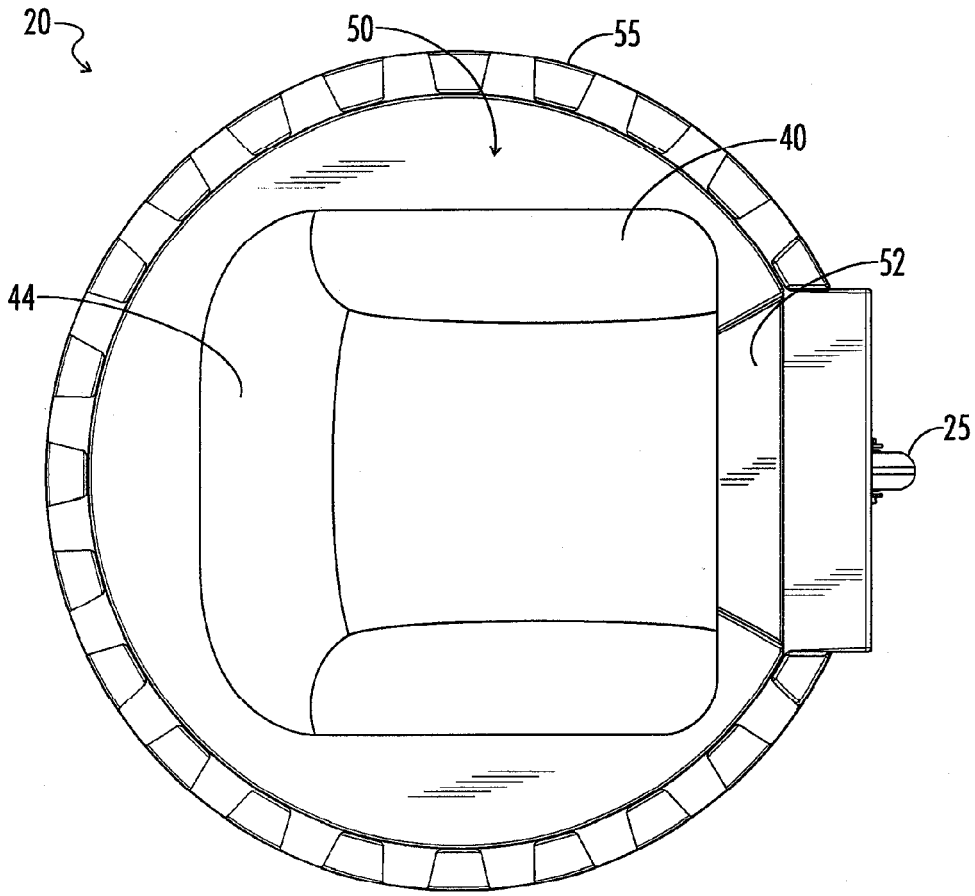
FIG. 6 is a top plan view thereof.
Figure 7:
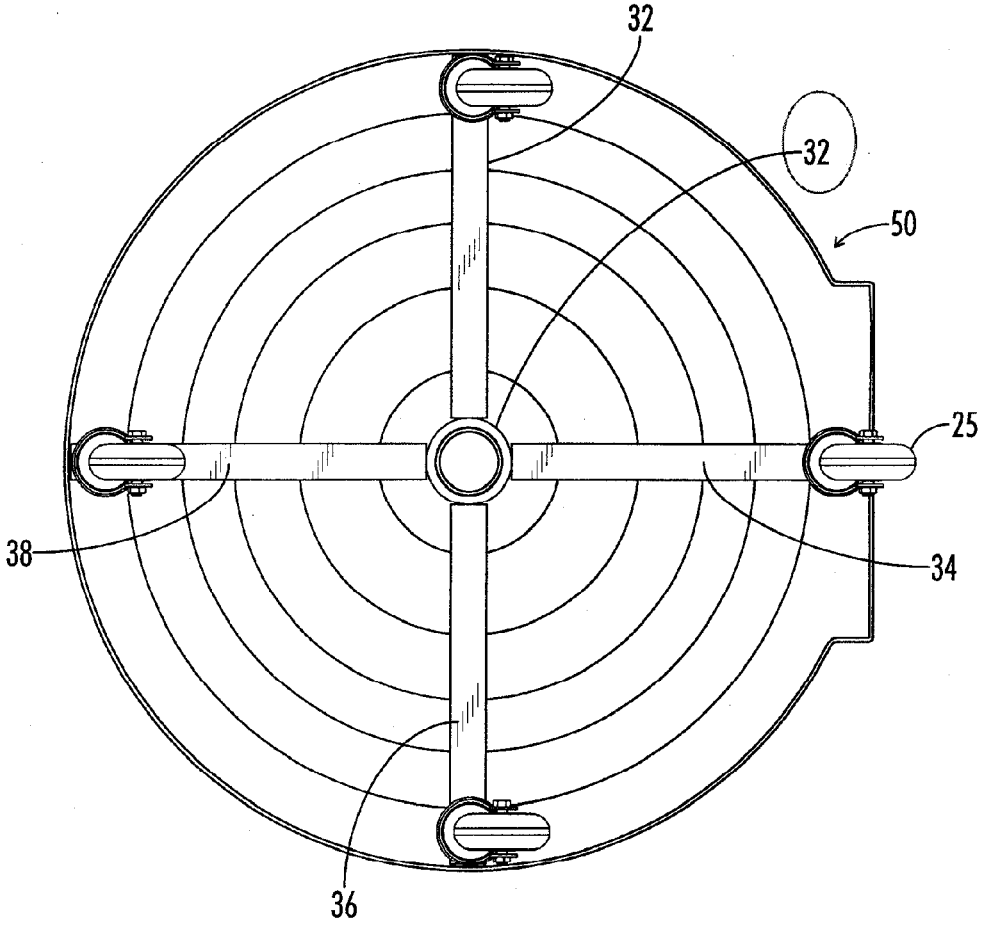
FIG. 7 is a bottom plan view thereof.
Figure 8:
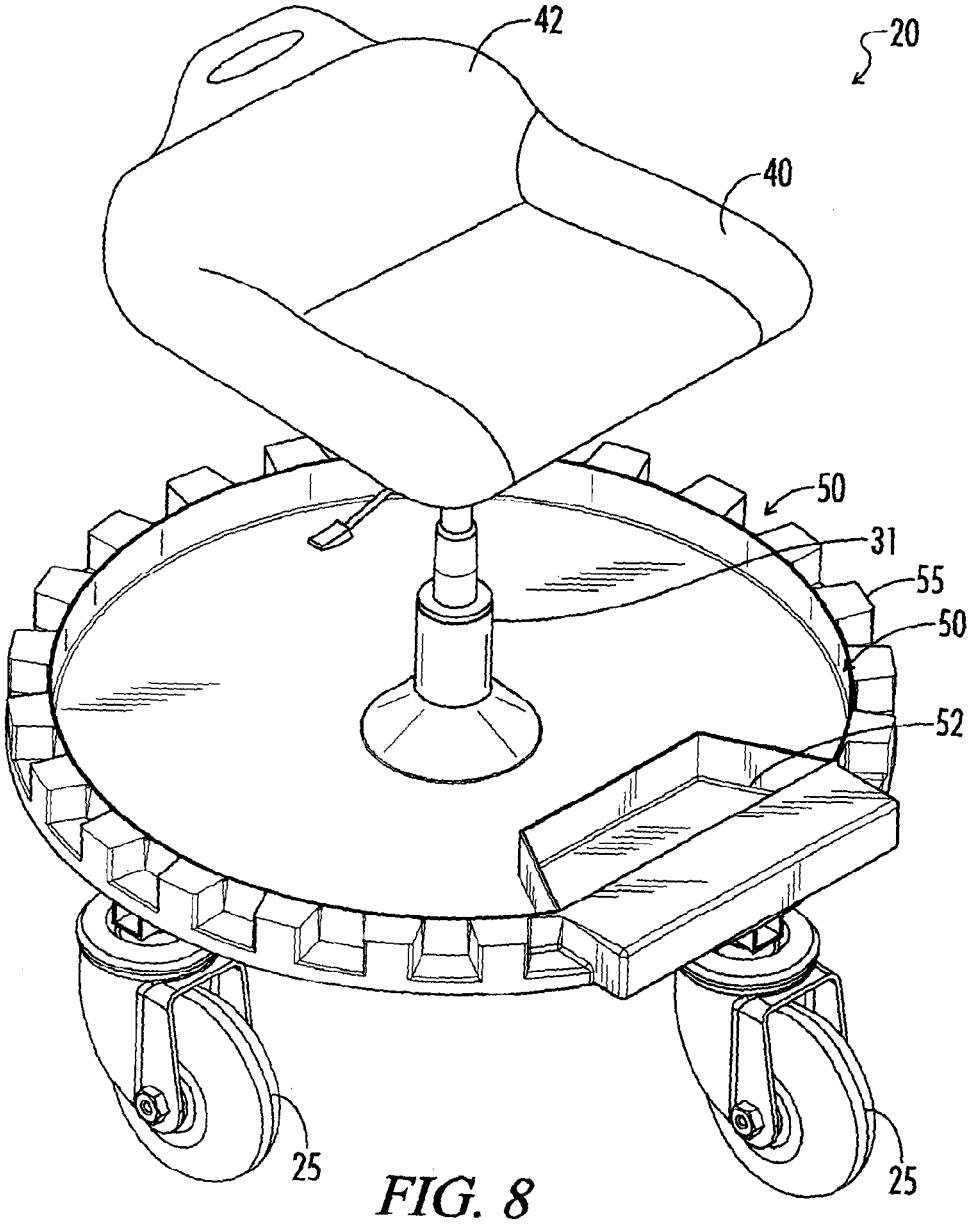
FIG. 8 is a perspective view taken generally from the top of another exemplary embodiment of the rolling chair and tool bin at a site in accordance with the present invention; and, FIG. 9 is a front elevational view thereof with portions omitted for clarity.
Figure 9:
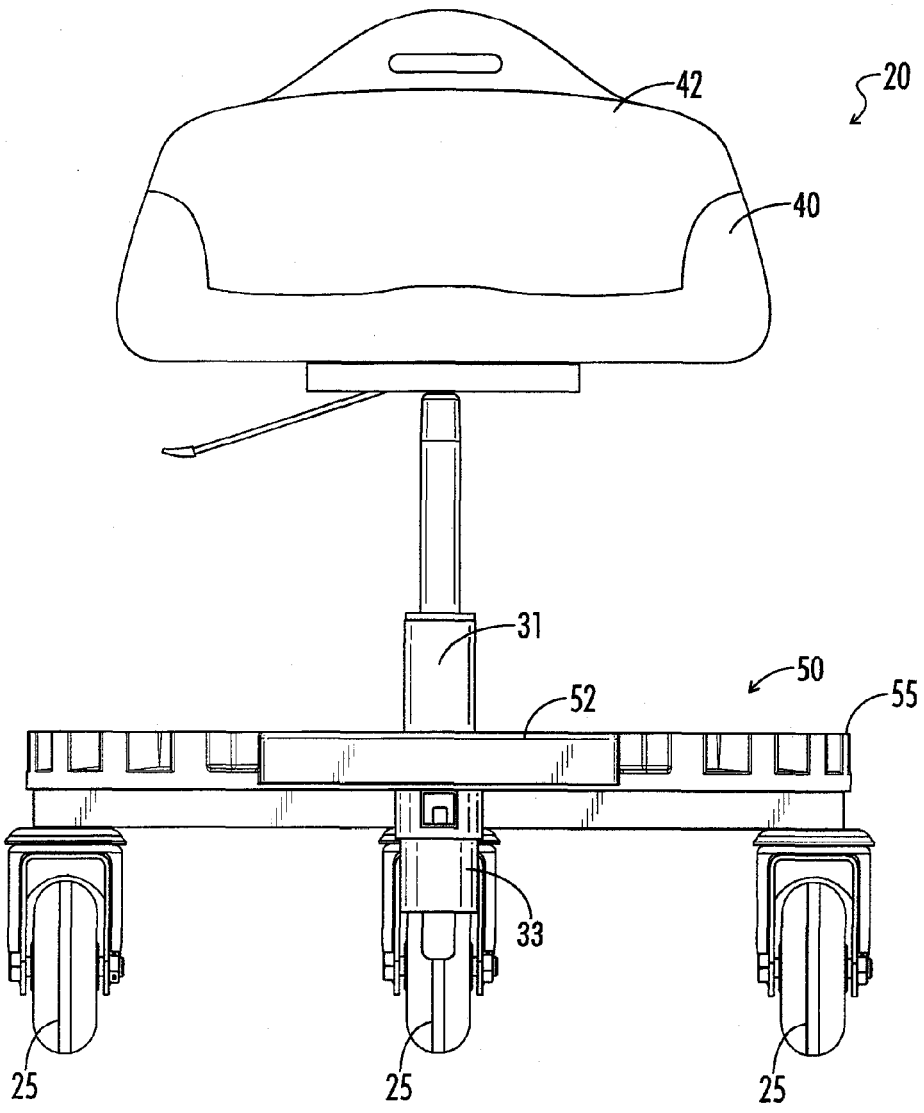

In one exemplary embodiment in accordance with the present invention and shown in FIGS. 1-7, an improved rolling chair and tool bin 20 is used on a floor to move around a work area. The rolling chair 20 uses castered wheels 25 to support a rigid frame 30 and a rotary platform 50. The castered wheels 25 may be standard two inch wheels as shown in FIGS. 1-7 (in another embodiment discussed hereinafter, the wheels may be much larger, preferably having a diameter of at least four inches and more preferably at least five inches, which enable the wheels 25 to move easily over obstacles often encountered in shops and garages as shown in FIGS. 8-9).

The chair 20 includes an underlying rigid frame 30 with a central riser 31 housing a pneumatic or gas powered cylinder (other cylinder types are acceptable as well). The frame 30 may be made from metal or a suitable substitute. In one exemplary embodiment, the rolling chair frame 30 defines an x-shaped cross-section with legs 32, 34, 36, 38 extending outwardly from the central riser 31 to a terminus that each couple with a castered wheel 25. The frame 30 may incorporate hollow members into its structure to decrease the overall weight of the rolling chair 20.

The central riser 31 is generally topped by a seat 40 with an integral back 42, but seats without backs may also be employed. The seat 40 and back 42 are preferably padded. The seat 40 includes a control mechanism for actuating the gas powered cylinder 45 that raises the seat in response thereto. The seat 40 is gravity biased downwardly by the user's weight to move downwardly while the gas powered cylinder 45 raises the seat. The cylinder may be gas powered or pneumatic or hydraulic as desired.

The rolling chair 20 includes a circular rotary platform 50 that a user may employ to hold or store items such as parts or tools. The platform 50 may also include a smaller sectioned tray 52 that is useful for storing small parts such as nuts, bolts and the like. The platform 50 has an outer perimeter 55 that is above the vertical axis of the wheels 25. The outer perimeter 55 has more mass and weight than the inner portions of platform 50, which places the center of gravity closer to the wheels to promote stability during use. In one exemplary embodiment, the entire platform 50 may be rotated about a central axis to enable the user to easily access all portions of the platform similarly to a lazy susan design.

In another exemplary embodiment shown in FIGS. 8-9, the rolling chair 20 is suspended above the ground by several large castered wheels 25. In addition to the central riser 31, a sleeve 33 extends beneath the frame to lower the effective height of the seat relative to the ground to accommodate the increased height of the wheels 25. The sleeve 33 extends downwardly approximately two inches although this distance could be increased if necessary to accommodate larger wheels to maintain the seated distance above the ground.

Each wheel 25 is identical and the description of each wheel 25 applies to all of the wheels 25. Wheel 25 may be of various sizes but a five inch diameter wheel is suitable but other larger sizes are also possible. Wheel 25 is a castered wheel in that it is a wheel mounted to a casing with ball bearings permitting complete rotation about the vertical axis about an upper stem while the wheel also rotates about a central axle. The casing includes a protruding stem adapted to be mounted into a receptive cavity in the rolling chair 20, in this case at the terminus of each of the legs. The wheels 25 may be locked into place to prevent rotation about their horizontal axes as desirable.

For example, if the wheels 25 encounter a wire, such as an extension cord, power cord, light cord or some similar obstacle, the wheels ride over the obstacle. Conventional rolling chairs often do not adequately roll over such obstacles, which is often problematic. Also, if the wheels roll into a depression, the wheels 25 absorb a substantial portion of the shock and the rolling chair 20 doesn't jostle the user as many other conventional designs might.

The apparatus of the invention is capable of receiving additional, optional features as well. For example, a purchaser or user may desire an adjustable padded bench or similar features known in the art. Other optional features, some of which may be illustrated herein, may or may not be included with apparatus incorporating the basic aspects of present invention.

In describing a preferred embodiment of the invention illustrated in the drawings, specific terminology has been used for the sake of clarity. However, the invention is not intended to be limited to the specific terms selected, and it is to be understood that each specific term includes all technical equivalents which operate in a similar manner to accomplish a similar purpose.

What is claimed is:

1. A rolling chair comprising:

a rigid frame with a plurality legs, each leg protruding outwardly from the frame to a terminal end;

a central riser protruding from the frame and housing an adjustable cylinder;

a seat supported by the adjustable cylinder adapted to selectively raise the seat;

a castered wheel at the terminal end of each leg and adapted to support the frame; and, a rotary platform between the legs and the seat and having a large storage area and a smaller walled portion and wherein the platform has an innermost section surrounded by an outer perimeter wherein the outer perimeter has more mass than the innermost section and the outermost printer is disposed above and proximate the wheels.

2. The rolling chair as recited in claim 1 wherein the castered wheels have a diameter of at least five inches.

3. The rolling chair as recited in claim 2 wherein the central riser protrudes above and below the frame.

4. A rolling chair comprising:

a rigid frame with a plurality legs, each leg protruding outwardly from the frame to a terminal end;

a central riser extending upwardly from the frame and housing an adjustable cylinder;

a seat supported by the cylinder;

a castered wheel at the terminal end of each leg and adapted to support the frame; and, a rotary platform between the legs and the seat and having a large storage area and a smaller walled portion and wherein the platform has an innermost section surrounded by an outer perimeter wherein the outer perimeter has more mass than the innermost section and the outermost perimeter is disposed above and proximate the wheels.

5. The rolling chair as recited in claim 4 wherein the adjustable cylinder is adapted to selectively raise the seat.

6. The rolling chair as recited in claim 4 wherein the adjustable cylinder is pneumatically powered.

7. The rolling chair as recited in claim 4 wherein the tool tray is secured to the proximate edge of the platform.

8. The rolling chair as recited in claim 4 wherein the tool tray is adapted to be inserted about the proximate edge of the platform.

* * * * *